United States Patent [19]

Lefferts et al.

[11] 4,362,776

[45] Dec. 7, 1982

[54] SIEVE BELT WITH FILLER MATERIAL

[75] Inventors: Johannes Lefferts, LM Enschede; Roelof Roelofs, LT-Hengelo, both of Netherlands

[73] Assignee: Siteg Siebtechnik GmbH, Ahaus-Alstatte, Fed. Rep. of Germany

[21] Appl. No.: 311,228

[22] Filed: Oct. 14, 1981

[30] Foreign Application Priority Data

Oct. 22, 1980 [DE] Fed. Rep. of Germany ..... 3039873

[51] Int. Cl.[3] ..... D04H 3/02

[52] U.S. Cl. ..... 428/222; 29/241; 29/433; 162/DIG. 1; 162/348

[58] Field of Search ..... 428/222; 162/DIG. 1, 162/348; 29/241, 433

[56] References Cited

U.S. PATENT DOCUMENTS 4,346,138 8/1982 Lefferts ..... 428/222

*Primary Examiner*—James J. Bell

*Attorney, Agent, or Firm*—Sughrue, Mion, Zinn, Macpeak & Seas

[57] ABSTRACT

The sieve belt is comprised of a multiplicity of helices made of thermosettable synthetic resin material which are interlocked with each other by inserting a plurality of pintle wires into the channels defined by the overlapping helices. For controlling the air permeability of the sieve belt, the hollow interiors of the helices are filled with a filler material comprised of crimped synthetic filaments.

10 Claims, 4 Drawing Figures

SIEVE BELT WITH FILLER MATERIAL

BACKGROUND OF THE INVENTION

The present invention relates to a sieve belt comprised of a multiplicity of helices made of thermosettable synthetic resin material, especially synthetic resin wire, with adjacent helices intermeshed with each other so that the windings of one helix enter between the windings of the adjacent helix and pintle wires which are inserted through the respective channels thus formed by the intermeshed helices. For controlling the air permeability of the sieve belt the hollow interiors of the helices are filled with a filler material. The invention further relates to a method for producing such a sieve belt.

Due to varying requirements, it is desirable to be able to change the air permeability of sieve belts made of synthetic resin helices. In the sieve belt disclosed in U.S. patent application Ser. No. 111,497 filed Jan. 11, 1980 now U.S. Pat No. 4,346,138 in the name of Johannes Lefferts and assigned to the same assignee as the present application, the spirals or helices are open and the air permeability is very high. In papermaking machines operating at very high speeds, high air permeability may be disadvantageous since it causes very intense air circulation which may disturb the paper web. The air permeability could be reduced by inserting stiff monofilaments into the interiors of the helices from the sieve belt edges or by inserting spun yarns or multifilament yarns by means of a threading device. However, such inserted material would lie straight in the interiors of the helices so that a large amount of filling material would be required to appreciably reduce the air permeability. Moreover, the large amount of filler material would greatly increase the weight per unit area of the sieve so that the insertion of the filler material and generally the handling of the sieve would become cumbersome, especially in the mounting of the sieve belt on the papermaking machine. The later introduction of filler material into the assembled sieve belt meets with difficulties and brings about disadvantages. Either the filler materials are introduced into the interlocked helices before the sieve belt is thermoset or the filler materials are inserted into and threaded through the channels after thermosetting. In both cases, the sieve belt must be thermoset a second time after insertion of the filler material since otherwise, the filler material might shrink later on under the influence of the papermachine temperature. Two thermosetting steps are very expensive and time consuming. Moreover, when the filler material is introduced prior to thermosetting of the sieve belt, there is the risk that the helices may shift over the pintle wires which are still straight at that stage so that humps and buckles may develop in the sieve belt. Furthermore, in both modes of operation, a certain length of filler material would have to extend laterally from the sieve belt so that after thermosetting and shrinkage of the filler material, the sieve belt will still be filled across its entire width. Such a method would be complicated and susceptible to trouble.

Another disadvantage resides in the fact that the filler material extends straight through the helices so that it can easily slip out of the sieve belt. For instances, if the edge of the sieve belt is damaged in the papermaking machine, the filler material can easily get caught on parts of the papermaking machine and will then be pulled out of the sieve belt. This may happen when the sieve belt laterally chafes against the machine.

SUMMARY OF THE INVENTION

The present invention provides a new and inproved sieve belt having reduced air permeability which can be produced quickly and economically.

According to the present invention, the filler material, for example multi-filament or mono-filament yarn, spun yarn or taped yarn, is disposed in the hollow interiors of the helices in a completely untensioned state in a stuffed or crimped condition. Since no tension is exerted on the filler material it expands in a transverse direction thereby filling the hollow interiors of the helices better and more uniformly than a tensioned yarn. Especially with the use of softly twisted multi-filament yarns and spun yarns as filler materials, the individual fibers are uniformly distributed throughout the hollow space so that the sieve belt does not have any open areas.

The present invention provides a new and improved method for assembling sieve belts with filler material in that the filler material contained in the hollow interiors of the helices yields as the helices are interlocked and can be easily pushed aside thereby permitting the use of already filled helices for the manufacture of the sieve belt. The channel into which the pintle wire is to be inserted is formed without any particular difficulties. Straight mono-filaments or multi-filaments, when used as filler material, would not make room for the formation of the channel and would offer considerable resistance to interlocking of the helices. If such a filler material were used it could be introduced into the hollow helix interiors only after interlocking of the helices.

The aforementioned difficulties resulting from the filling of the helices after they have been interlocked to form the sieve belt are not encountered in the manufacture of the sieve belt according to the present invention. Although minor shrinkage of the filler material may occur on thermosetting of the filled sieve belt, sufficient length of the filler material is available to allow for such shrinkage, that is, after thermosetting of the sieve belt the filler material is still more or less undulated rather than straight in the hollow interior of the helices. This undulation causes sufficient friction in the interior of the helices to prevent slipping of the filler material out of the helices even if the edges should be damaged. This is significant particularly with the use of smooth material, for example mono-filaments, twisted mono-filaments or multi-filaments. Slippage of the filler material out of the helices can also be prevented by forcing the material into the interior of the helices. However, in practice this cannot be realized because the sieve belts would become very heavy and the helices so plugged as to be no longer capable of being interlocked.

In principle, there are two possibilities for filling the interiors of the helices before interlocking them, namely, either to wind the synthetic resin wire around the filler material when the helices are formed or to fill the helices with filler material after their formation but prior to interlocking. In the second case, the helices can be filled so that first one or more monofilament wires are threaded into the interior of the helices and thereafter the filler material is deformed under external influences, for example by wrapping the helices with a yarn so that the wraps of the yarn come to lie between the windings of the helices and then tensioning the yarn in a direction normal to the longitudinal axis of the helix. In this manner, the yarn tends to pull the filler material somewhat out between the helix windings normal to the helix axis. In this state, the filler material is thermoset. Another possibility is to deform the filler material from the outside by gears or by impressing other helices. Finally, a yarn composed of a less shrinkable and a highly shrinkable component may be employed. Such a yarn will crimp automatically during thermosetting. The same effect can be obtained with the use of bicomponent filaments.

The sieve belt according to the present invention is especially suited for use with a paper machine sieve and is especially advantageous when used in the pressing section of a papermaking machine.

The foregoing and other objects, features and advantages of the invention will be apparent from the following more particular description of preferred embodiments of the invention as illustrated in the accompanying drawings.

DETAILED DESCRIPTION OF THE INVENTION

As described in prior U.S. application Ser. No. 111,497 (supra) the sieve belt is comprised of a plurality of intermeshed helices joined together by a plurality of pintle wires, one in each channel formed by two adjacent helices.

Figure 1:
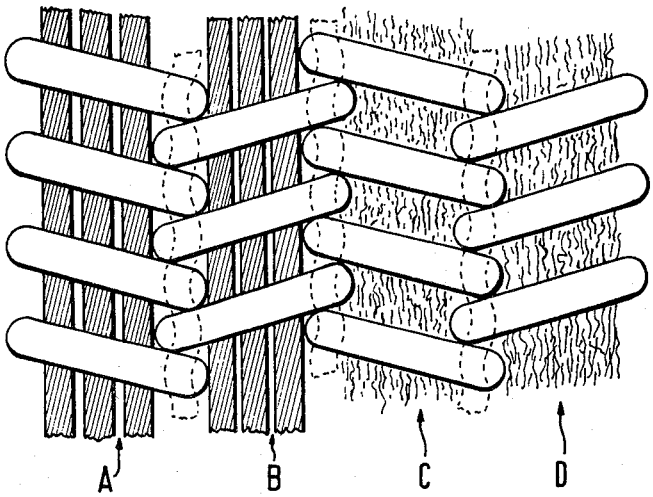
FIG. 1 is a schematic view of a sieve belt having filled helices showing a comparison between straight filling material and untensioned or crimped filling material.
Figure 2:
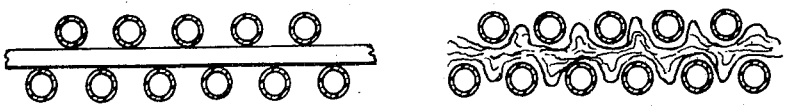
FIG. 2 is a longitudinal sectional view of the two arrangements shown in FIG. 1 comparing the helices filled with a straight tensioned yarn and the helices filled with untensioned filler material thermoset in a wavey configuration.
Figure 3:
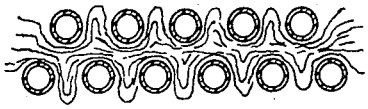
FIG. 3 is a sectional view similar to FIG. 2 showing how the filler material extends beyond the helix arcs when the filler yarn is initially provided with a greater excess length.

As illustrated in FIG. 1 of the present application, the hollow interior of each helix is filled with a filler material. The spaces A and B of the two helices at the left of FIG. 1 are filled with straight mono-filament yarn while the spaces C and D on the right of FIG. 1 are filled with a bulky multi-filament or spun yarn. It is clear that voids are still present in the interior spaces A and B, for example where the helix arcs of adjacent helices intermesh, while the bulky filler material completely fills the interior spaces C and D. From FIG. 2 it may be seen that the filler material on the right not only fills the hollow interiors of the helices but that it also partially enters between the helix arcs. In this manner, the surface of the sieve belt is closed and equalized and the chance of very slight markings caused by the sieve belt is further reduced. Moreover, such a complete filling of the spaces between the helix arcs enlarges the supporting area of the sieve belt which promotes drying of the paper. By providing the filler material with an especially great excess length, it is possible that the filler material will even extend beyond the arcs as seen in FIG. 3. This imparts a soft surface to the sieve belt.

Figure 4:
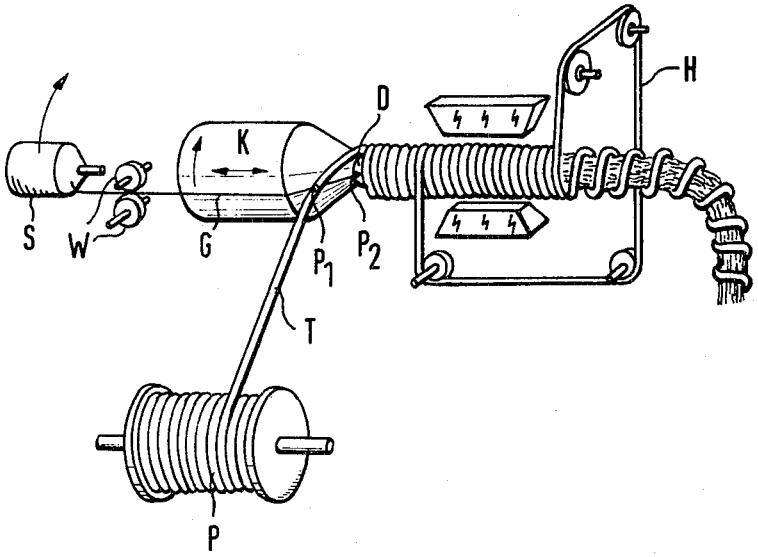
FIG. 4 is a schematic view showing the apparatus for manufacturing filled helices for a sieve belt according to the present invention.

An arrangement for producing filled helices is shown in FIG. 4. The portion of the method for producing the helix is similar to that disclosed in prior application Ser. No. 111,497 (supra). The apparatus comprises a rotating mandrel D and a cone K which are guided in a reciprocating manner at one end of the mandrel 20. The helix is produced by feeding a first filament T from a package P to the rapidly rotating mandrel D. The first filament T is thus wound onto the mandrel 20 by means of the cone K which reciprocates rapidly and the thus formed helix is pushed across the mandrel past heating means to the righthand side as viewed in FIG. 4.

The arrangement according to the present invention further provides for a filler yarn G which is withdrawn from a package S and passes between rolls W which are adjustable as to speed. The package S and the rolls W are connected to the shaft of the mandrel D so as to rotate as a unit with the mandrel D and the cone K about the longitudinal axis of the mandrel D. Moreover, the package P for the filament T from which the helices are formed is arranged so that the filament T first comes into contact with the cone K at the point P1 in the outer third of the cone K, then passes over the inner part of the cone K and is finally wound about the mandrel D. The filler yarn G contacts the cone K at the periphery thereof and is engaged by the filament T at the point P1, that is, it is clamped between the filament T and the surface of the cone K. As the filament T slides over the inner part of the cone K, it takes along a portion of the filler yarn G disposed between the points P1 and P2. The point P2 is located at the transition between the cone K and the mandrel D, that is, at the point where the winding of the helix starts. By adjusting the speed of the rolls W the length of the piece of filler yarn G which is taken along by the filament T can be controlled and is then placed within the winding of the helix. The filler yarn G is urged laterally outwardly between the windings of the filament T and the auxiliary wire H and is set in this condition by the heating means. The excess length of the filler yarn G is thermoset in this way, that is, the excess length of the filler material is consumed in the crimping of the material. After the auxiliary wire H has left the mandrel D and the helix has been pushed from the mandrel D the thermoset crimps of the filler yarn G slip into the interior of the helix and spread out in the hollow interior of the helix.

The extent of crimping of the filler yarn G is determined by the peripheral speed of the rolls W as mentioned before. The extent of crimp generally varies between 1.2 and 8, that is, in a given length of the helix 1.2X to 8X this length of filler yarn is disposed. Lower values for the crimp are also possible.

To complete the manufacture of the sieve belt, the filled helices are pushed laterally one into the other so that the windings of one helix come to lie between the windings of the adjacent helix. The helices are pushed into one another to the extent necessary to form a channel into which a pintle wire is inserted for firmly locking the helices together. Finally, the sieve belt is thermoset under tension so that the helices are somewhat buried in the material of the pintle wire thereby causing the pintle wire to assume a wavy configuration. As the helices are thus interlocked, the filler material in one helix is pushed away by the windings of the other helix. Since the filler material is very bulky, it does not offer too much resistance and yields to the pressure.

The air permeability of the sieve belt is determined, inter alia, by the type of filler material and the extent of its crimp. Thus, for example, in a sieve belt having a thickness of 2.5 mm and comprised of helices having a wire thickness of 0.7 mm, pintle wire having a wire thickness of 0.9 mm and 20 pintle wires per 10 cm of sieve length, the air permeability is 320 $m^3$ per $m^2$per minute at a pressure differential of 12.7 mm water head. When the same sieve belt is made from helices filled with two textured polyamide multi-filament yarns of 1300 dtex each having a 1.5 crimp, the air permeability drops to 140 $m^3$per $m^2$per minute.

Other types of filler material may be used such as one having a linear textile structure. "Tape yarn" is also usable and is chemical tape (extruded and slit), spliced tape or woven tape.

While the invention has been particularly shown and described with reference to preferred embodiments thereof, it will be understood by those in the art that the foregoing and other changes in form and details may be made therein without departing from the spirit and scope of the invention.

What is claimed is:

1. A sieve belt comprised of a plurality of helices made from thermoset synthetic resin material with adjacent helices intermeshed so that the windings of one helix enter between the windings of the adjacent helix, a pintle wire disposed in each of the respective channels formed by the intermeshed windings of adjacent helices and a filler material within the hollow interior of each of the helices, said filler material being comprised of crimped or undulating filaments.

2. A sieve belt according to claim 1, wherein the initial length of the filler material in the hollow interior of the helix exceeds the length of the helix.

3. A sieve belt according to claims 1 or 2, wherein said helices are unbiased.

4. A sieve belt according to claim 3, wherein the synthetic resin material is a torsion-free mono-filament wire.

5. A sieve belt according to claim 3, wherein each helix is comprised of a yarn composed of two individual filaments.

6. A sieve belt according to claim 3, wherein the crimped filler material is thermoset.

7. A sieve belt according to claim 3, wherein the filler material is a mono-filament or multi-filament yarn, spun yarn or taped yarn.

8. A method for producing a sieve belt comprising filling the interior of a plurality of helices with a filler material, intermeshing a plurality of helices so that the windings of one helix are disposed between the windings of an adjacent helix to define a channel and inserting a pintle wire through each channel.

9. A method according to claim 8, wherein during the production of the helices a synthetic resin wire is wound about said filler material.

10. A method according to claim 9, further comprising thermosetting the filler material in an undulated or crimped condition.

* * * * *